United States Patent [19]

Walker et al.

[11] Patent Number: 5,055,808

[45] Date of Patent: Oct. 8, 1991

[54] BANDWIDTH AGILE, DIELECTRICALLY LOADED RESONATOR FILTER

[75] Inventors: Brian C. Walker; Robert J. Munn, both of Albuquerque, N. Mex.

[73] Assignee: Motorola, Inc., Schaumburg, Ill.

[21] Appl. No.: 586,471

[22] Filed: Sep. 21, 1990

[51] Int. Cl.[5] ..... H01P 1/202

[52] U.S. Cl. ..... 333/207; 333/202; 333/235

[58] Field of Search ..... 333/202, 206, 207, 222, 333/223, 235, 101, 103

[56] References Cited

U.S. PATENT DOCUMENTS

| | | | |
|---|---|---|---|
| 4,431,977 | 2/1984 | Sokola et al. | 333/206 |
| 4,459,571 | 7/1984 | Fraser | 333/202 |
| 4,462,098 | 7/1984 | D'Avello et al. | 370/30 |
| 4,692,726 | 9/1987 | Green et al. | 333/206 |
| 4,740,765 | 4/1988 | Ishikawa et al. | 333/206 |
| 4,742,562 | 5/1988 | Kommrusch | 333/202 X |
| 4,800,347 | 1/1989 | Yorita et al. | 333/202 |
| 4,800,348 | 1/1989 | Rosar et al. | 333/202 |

OTHER PUBLICATIONS

Miscrowave & RF Magazine, Oct., 1989, p. 150, Tunable Filter Varies Bandwidth, Center Frequency.

Electronics, Jul. 14, 1983, pp. 129–131, by Tomoki Uwano, Ceramic-Filled Resonator Cuts Costs of Radio-Telephone Filters.

RF Design Magazine, Mar., 1989, pp. 35–42, 129–131, by Darioush Agahi, Motorola, Inc., Monolithic Ceramic Block Combline Bandpass Filters.

Motorola, Inc., Technical Writing Services, No. 68P81049E82-D, Nov. 5, 1985-PHI, Trisolector Assembly and DYNAT-A-C Cellular Radiotelephone Transceiver Description.

RF Circuit Design, 1985, by Chris Bowick, pp. 62–65.

Motorola Technical Developments, vol. 8, Oct. 1988, p. 11, by Richard Kommerusch, Band Tunable Ceramic Block Filter.

*Primary Examiner*—Eugene R. LaRoche
*Assistant Examiner*—Seung Ham
*Attorney, Agent, or Firm*—Raymond A. Jenski; Steven G. Parmelee; Anthony J. Sarli

[57] ABSTRACT

A bandwidth agile, dielectrically loaded resonator filter is disclosed in which conductive strips (320, 322), plated on the top surface (302) of the filter and disposed between resonators (310, 312, 314), are selectively switched to ground in order to affect a change in the bandwidth without appreciably changing the center frequency of the filter response. PIN diode switching networks (316, 318), including a means for biasing the diode, are used to effectively ground the strips between the nearly quarter-wavelength transmission line resonators contained within the block (300) of the filter, thereby capturing a portion of the capacitive coupling (402, 404) which occurs mostly beneath the surface of the filter between adjacent resonators.

15 Claims, 2 Drawing Sheets

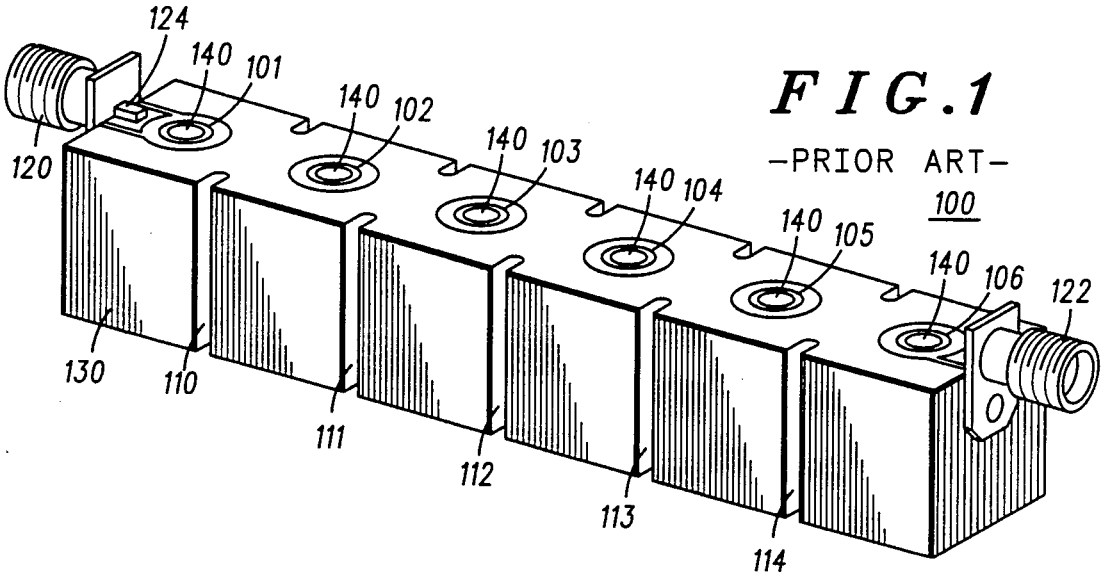
FIG. 1
-PRIOR ART-
100
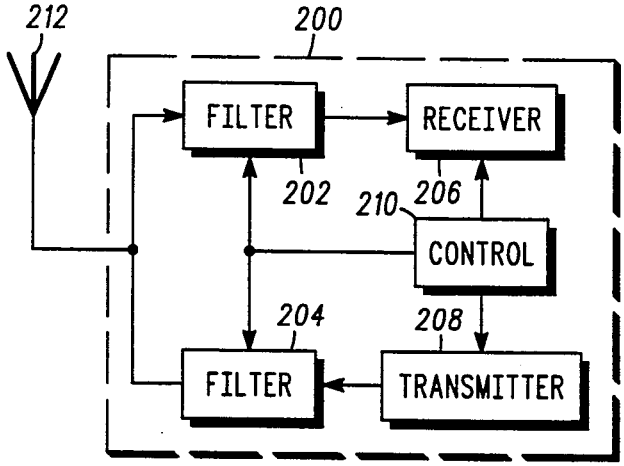
FIG. 2
FIG. 3A
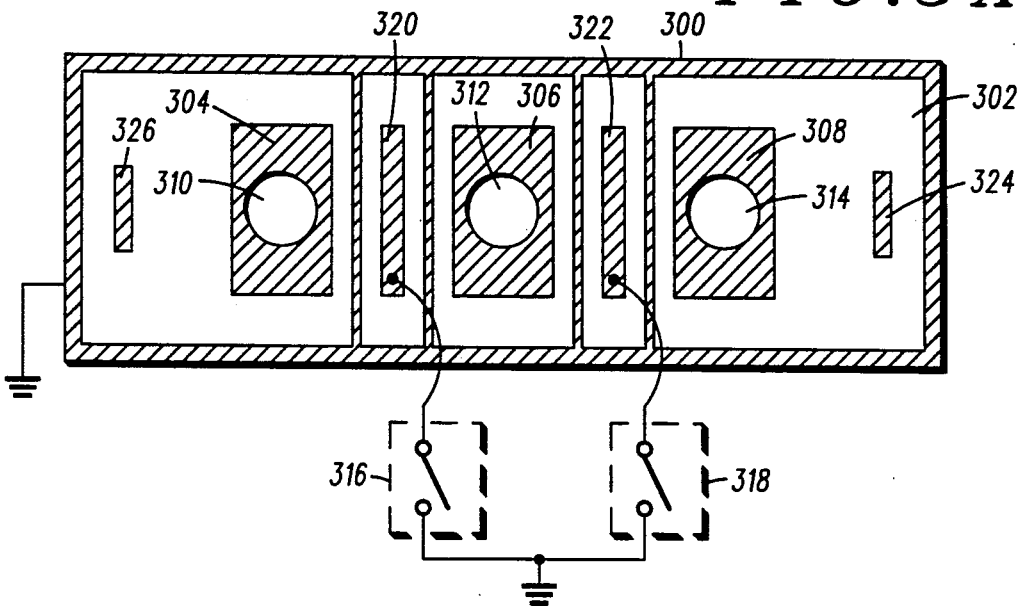

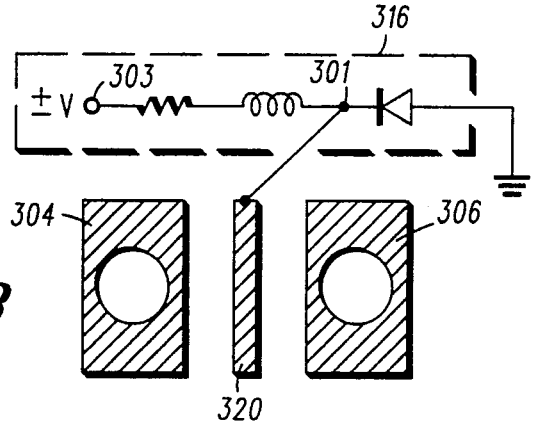
FIG. 3B
FIG. 4
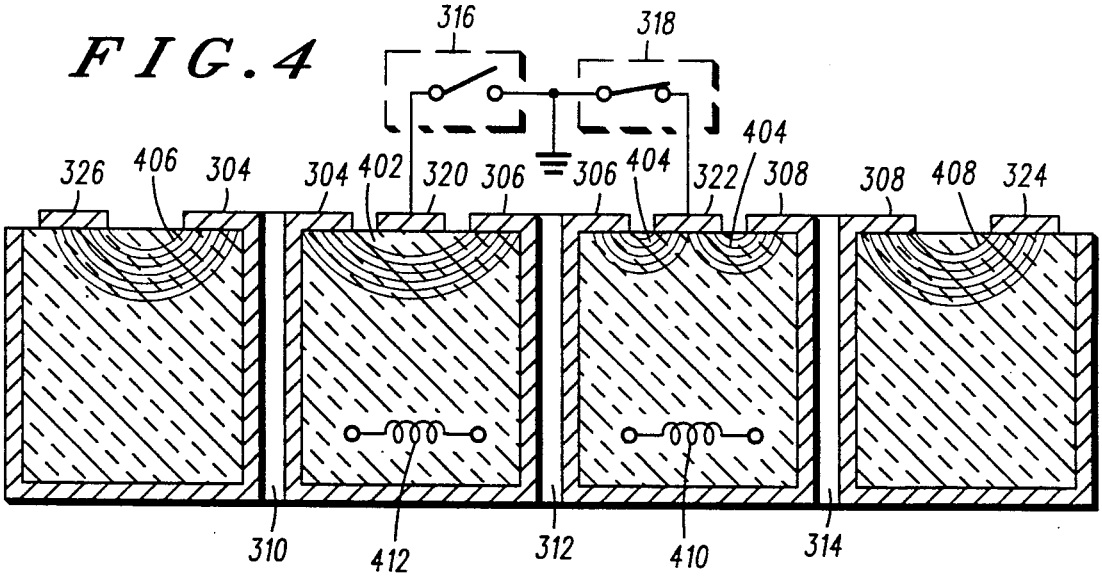
FIG. 5
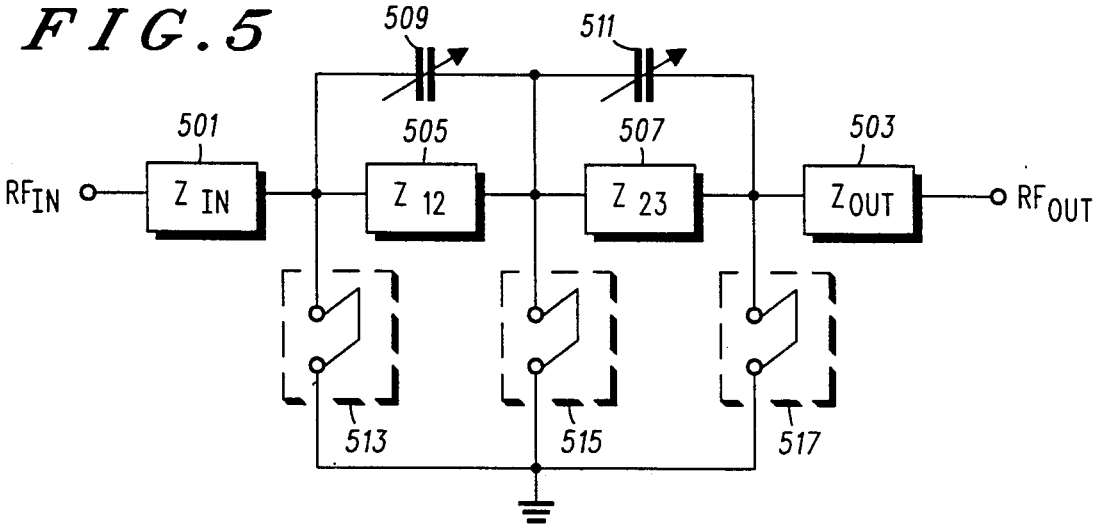

BANDWIDTH AGILE, DIELECTRICALLY LOADED RESONATOR FILTER

FIELD OF THE INVENTION

The present invention relates generally to dielectric block filters, and more particularly relates to bandwidth agile dielectrically loaded resonator filters used in two-way communication systems. Reference is made to U.S. patent application Ser. No. 586,464 "Frequency Agile Dielectrically Loaded Resonator Filter", filed on behalf of Munn on the same date herewith, assigned to the assignee of the present invention, and containing material which may be related to the present invention.

BACKGROUND OF THE INVENTION

Dielectric block bandpass filters, for example as in U.S. Pat. No. 4,431,977, "Ceramic Bandpass Filter", are commonly used as signal filters in communication systems, for example as in a conventional radio, transceiver, or radiotelephone. Conventional dielectric filters offer advantages in both physical and electrical performance which make them ideally suited for use in mobile and portable radio transceivers. Multi-resonator dielectric filters, as depicted in FIG. 1, typically comprise a plurality of nearly quarter-wavelength transmission line resonators, constructed by making through-holes in the dielectric material, and plating these holes with a conductive material. In such a configuration, reactive coupling between adjacent resonators can be controlled by the physical dimensions of each resonator and by the orientation of each resonator with respect to the other resonators.

It is also commonplace to use diodes for electronically switching components in applications such as voltage controlled oscillators, duplexers, and other areas where high speed switching is required. Voltage variable capacitors are also used for tuning in applications such as electronically tuned helical resonators, for example in U.S. Pat. No. 4,459,571, "Varactor-tuned Helical Resonator Filter".

Altering the frequency characteristics of resonant loads is not a new idea, and such a resonant load may be a VCO, as in U.S. patent application Ser. No. 538,874, "Diode Bias Networks for Use With Voltage Controlled Oscillators", filed on behalf of Gehrke et al. on June 15, 1990, and assigned to the assignee of the present invention. Unfortunately, such a configuration relies on relatively high voltage levels generated by the VCO in order to cause self-rectification in the diode switch, resulting in a reverse bias condition. In typical filter applications, there are not sufficient voltage levels to guarantee reverse biasing, hence the switch could never be in an 'off' state using this technique. Regarding the use of voltage variable capacitors, these devices typically offer very poor temperature stability, thereby requiring additional components for temperature compensation. The cost of adding these components can be significant when compared to the total cost of the filter.

In short, known solutions to the bandwidth adjustment of filters used in communication systems, especially for miniaturized, dielectrically loaded resonator filters, are inadequate when a real-time adjustable bandwidth is desired. It would be advantageous to have one filter which could be electronically configured for use in multiple frequency environments, such as the case in a conventional cellular radiotelephone operating domestically in one frequency environment and in a different frequency environment in a foreign country. Clearly, there is a need for a temperature stable, electronically-selectable-bandwidth filter which is not constrained by the aforementioned shortcomings.

SUMMARY OF THE INVENTION

The present invention encompasses a bandwidth agile dielectrically loaded resonator filter having an electronically changeable response bandwidth. A plurality of holes extend from a first of at least three external surfaces toward a second external surface, the interior of which holes have a conductive coating to form a resonator having predetermined frequency characteristics. The conductive coating is coupled to a conductive layer disposed on the first external surface. A conductive strip is disposed on the first external surface between at least two adjacent resonators, and coupled to a switch. The switch is further coupled to a conductive coating disposed on at least the second external surface.

BRIEF DESCRIPTION OF THE DRAWINGS

FIG. 1 is a perspective view of a conventional dielectric filter illustrating the orientation of the resonator elements and the input/output coupling.

FIG. 2 is a block diagram of a radio employing the present invention.

FIG. 3A is a top view of a bandwidth agile dielectrically loaded resonator filter, according to the invention.

FIG. 3B is a more detailed view of one of the filter sections of FIG. 3A.

FIG. 4 is a cross sectional view of the filter of FIG. 3A, showing the various surface coupling characteristics, according to the invention.

FIG. 5 is a schematic diagram showing an equivalent circuit of a bandwidth-adjustable dielectric filter, according to the invention.

DETAILED DESCRIPTION OF A PREFERRED EMBODIMENT

Using dielectric block filters on the front end of a radio is quite common. FIG. 2 shows a simplified block diagram of a radio 200 where the invention may be employed. The radio 200, having a receiver 206, a transmitter 208, two front end filters 202 and 204, and a controller 210 used for selecting the desired bandwidth of the filters, is coupled to an antenna 212. The radio 200, as shown in FIG. 2, is intended to represent a conventional communication system device which may include only a conventional receiver or only a conventional transmitter for one-way communication, or both for two-way communication.

FIG. 3A shows the top view of a bandwidth agile, dielectrically loaded resonator filter in accordance with the invention and its preferred embodiment thereof. A six-sided block 300 having a top surface 302, and five additional surfaces (not shown, and which are completely covered with a conductive layer) is depicted. Shown on opposing ends of external surface 302 are input pad 326 and output pad 324 which serve to couple the filter to a radio frequency (RF) signal. In the preferred embodiment of the invention, three holes are disposed through block 300 and plated to form nearly quarter-wavelength transmission line resonators, which resonators are denoted by numbers 310, 312, and 314. Conductive layer 304 is connected to resonator 310 and disposed on external surface 302. Conductive layer 306 is connected to resonator 312 and disposed on external surface 302, while conductive layer 308 is similarly connected to resonator 314. Conductive strips 320 and 322 are disposed on external surface 302 and switchably coupled to ground via switching networks 316 and 318, respectively.

FIG. 3B, shows a more detailed view of one of the filter sections of FIG. 3A. It can be seen that switching network 316, for example, comprises a bipolar voltage source, a current limiting resistor, an RF choke, and a diode, which may be, for example, a PIN type. Under normal operating conditions resonators 310 and 312, for example, couple by means of exchanging electrical fields between conductive layers 304 and 306 on the surface of the dielectrically loaded resonator filter. This is commonly referred to as capacitive coupling, and to a large extent controls the response bandwidth of the filter for the particular stage where the coupling takes place. In order to adjust the predetermined bandwidth of the filter response, this coupling effect must be changed in some manner.

Referring to switching network 316, it can be seen that a negative voltage, supplied by bipolar voltage source 303 and imposed on the cathode of the diode at node 301, which may be, for example, a PIN type such as Hewlett Packard Part No. 5082-3900, results in a forward-biased condition rendering the diode electrically conductive. As such, conductive strip 320 sees a low impedance path to ground and begins to capture a portion of the electric field lines coupling conductive areas 304 and 306. Under these conditions the bandwidth of the filter response is altered. When bipolar voltage source 303 is positive, imparting a positive potential at the cathode of the diode at node 301, the diode becomes reverse-biased, placing it in a non-conducting state. As such, conductive strip 320 sees a high impedance path to ground and is held virtually ineffective in capturing electric fields between conductive areas 304 and 306. Under these conditions the bandwidth of the filter response remains unchanged.

FIG. 4 shows a cross sectional view of a bandwidth agile dielectrically loaded resonator filter according to the invention. For purposes of clarity, the magnetic coupling which takes place on the lower portion of the filter will not be discussed and is generically represented by inductances 412 and 410. In the preferred embodiment, the filter comprises three nearly quarter-wavelength transmission line resonators 310, 312, and 314, denoted identically as in FIG. 3A. These resonators are further connected to conductive layers 304, 306, and 308, respectively. RF input pad 326 is coupled to resonator 310 and conductive layer 304 by means of electric field lines 406. Similarly, RF output pad 324 is coupled to resonator 314 and conductive layer 308 by means of electric field lines 408. According to the invention, switching network 316 is coupled between conductive strip 320 and ground. Similarly, switching network 318 is coupled between conductive strip 322 and ground. It can be seen that, depending on the state of switching networks 316 and 318, the effect of the conductive strips between resonators will be changed. For example, switching network 316 is shown in an open state, and conductive strip 320 has virtually no impact on the coupling between resonator 310 and resonator 312. The electric field lines 402 are shown to be unimpeded in their path between conductive layers 304 and 306. Conversely, since switching network 318 is in a conducting state, conductive strip 322 sees a low impedance path to ground. As such, electric or capacitive coupling between resonator 310 and resonator 312 is significantly altered. Since conductive strip 322 offers the electric field lines 404 a low impedance path to ground, many of these electric field lines are terminated at conductive strip 322, thereby reducing the electric field coupling effect between resonators 312 and 314, thereby increasing the already predominantly magnetic coupling. It is in this manner that, through selective switching of networks 316 and 318, capacitive coupling between adjacent resonators is altered. As such, a plurality of response bandwidths is obtainable and electronically switchable.

FIG. 5 shows a simplified schematic of the preferred embodiment of the invention. Three resonators are represented by transmission line networks 513, 515, and 517. The RF input signal is coupled into the filter through impedance 501. Similarly, impedance 503 serves to couple the filter to the RF output signal. Impedances 501 and 503 are shown generically so as to not particularly characterize the input and output stages of the filter as either bandpass or band-reject, since the invention is well suited to both types of response. The magnetic and electric coupling between adjacent resonators is represented generically by impedances 505 and 507. Variable capacitances 509 and 511 are shown in parallel with their respective coupling networks, and represent the effect of the conductive strips 320 and 322 disposed on the surface of the filter between adjacent resonators. As was shown in FIG. 4, it can be seen that through switching of these conductive strips to ground, the capacitive coupling between resonators can be altered. This capacitive adjustment is shown between resonators 501 and 502 as variable capacitance 509. Similarly, the capacitive adjustment between resonator 502 and 503 is represented by variable capacitance 511.

What is claimed is:

1. A bandwidth agile dielectrically loaded resonator filter having at least three external surfaces, at least two holes extending from a first of the at least three external surfaces toward a second of the at least three external surfaces, and a conductive coating disposed on the second and a third external surface and an interior surface of each of the holes, the resonator filter having a response which is at least partially a bandpass type and having bandwidth characteristics which may be changed, comprising:

a first conductive layer disposed on the first external surface and coupled to the conductive coating disposed on the interior surface of a first of the holes;

a second conductive layer disposed on the first external surface and coupled to the conductive coating disposed on the interior surface of a second of the holes;

a first conductive strip disposed on the first external surface between said first and second holes; and first means for switching, disposed between said first conductive strip and the conductive coating disposed on the third external surface.

2. A dielectrically loaded resonator filter in accordance with claim 1, wherein each of the holes extend through from the first external surface to the second external surface.

3. A dielectrically loaded resonator filter in accordance with claim 1, wherein the conductive coating disposed on the second external surface is connected to the conductive coating on the interior surface of at least one of the holes.

4. A dielectrically loaded resonator filter in accordance with claim 1, further comprising means for applying a bipolar signal to said first means for switching.

5. A dielectrically loaded resonator filter in accordance with claim 1, wherein said first means for switching comprises a PIN diode.

6. A dielectrically loaded resonator filter in accordance with claim 1, further comprising:

a third hole, with an interior surface being substantially coated with conductive material to form a resonator;

a third conductive layer disposed on the first external surface and coupled to the conductive coating disposed on said interior surface of said third hole;

a second conductive strip disposed on the first external surface between said third conductive layer and another of said first and second conductive layers;

second means for switching disposed between said second conductive strip and the conductive coating disposed on the third external surface; and means for applying a bipolar signal to said second means for switching.

7. A dielectrically loaded resonator filter in accordance with claim 6, wherein said second means for switching comprises a PIN diode.

8. A bandwidth agile dielectrically loaded resonator filter having a plurality of external surfaces, comprising:

at least two resonators, each of said resonators further comprising a hole which extends from a first external surface of the dielectrically loaded resonator filter toward a second external surface of the dielectrically loaded resonator filter, and each hole having a conductive plating disposed on an interior surface thereof;

first and second conductive layers disposed on said first external surface and coupled, respectively, to a first and second of said at least two resonators;

a conductive strip disposed essentially between said first and second conductive layers;

a conductive coating disposed on at least said second external surface and a third external surface; and means for switching disposed beteen said conductive strip and said conductive coating.

9. A bandwidth agile dielectrically loaded resonator filter in accordance with claim 8, wherein the conductive coating disposed on the third external surface further extends onto the perimeter of the first external surface.

10. A bandwidth agile dielectrically loaded resonator filter in accordance with claim 8, further comprising means for applying a bipolar signal to said means for switching, whereby a different response bandwidth for said dielectrically loaded resonator filter may be realized.

11. A bandwidth agile dielectrically loaded resonator block filter, comprising at least three resonators, each of said at least three resonators formed from a hole which extends from a first external surface of the dielectrically loaded resonator block filter toward a second external surface of the dielectrically loaded resonator block filter, a conductive material disposed on an interior surface of each of said holes, at least three conductive layers disposed on the first external surface, each of said conductive layers independently coupled to a corresponding hole, said bandwidth agile dielectrically loaded resonator block filter further comprising:

a first conductive strip disposed essentially between a first and a second conductive layer;

a second conductive strip disposed essentially between said second and a third conductive layer;

a conductive coating disposed on all but the first external surfaces of the block filter;

first means for switching disposed between said first conductive strip and said conductive coating; and second means for switching disposed between said second conductive strip and said conductive coating.

12. A bandwidth agile dielectrically loaded resonator block filter in accordance with claim 11, wherein said conductive coating further extends from a third external surface toward a fourth external surface and essentially between said first and second conductive layers.

13. A bandwidth agile dielectrically loaded resonator block filter in accordance with claim 11, further comprising means for independently applying a bipolar signal to said first and second means for switching, whereby a different bandwidth for said dielectrically loaded resonator block filter may be realized.

14. A radio using a filter for selectivity, comprising:

a receiver;

a bandwidth agile dielectrically loaded resonator filter having at least three external surfaces, at least two holes extending from a first of the at least three external surfaces toward a second of the at least three external surfaces, and a conductive coating disposed on the second and third external surfaces and an interior surface of each of the holes, said bandwidth agile dielectrically loaded resonator filter having a predetermined response which is at least partially a bandpass type, which predetermined response bandwidth characteristics may be changed, said bandwidth agile dielectrically loaded resonator filter being coupled to said receiver and further comprising:

a first conductive layer disposed on the first external surface and coupled to the conductive coating disposed on the interior surface of a first of the holes;

a second conductive layer disposed on the first external surface and coupled to the conductive coating disposed on the interior surface of a second of the holes;

a first conductive strip disposed on the first external surface essentially between said first and second holes;

means for switching, coupled between said first conductive strip and the conductive coating disposed on the third external surface; and means, coupled to said receiver and said means for switching, for selecting at least one desired response bandwidth of said bandwidth agile dielectrically loaded resonator filter.

15. A radio using a filter for selectivity, comprising:

a transmitter;

a bandwidth agile dielectrically loaded resonator filter having at least three external surfaces, at least two holes extending from a first of the at least three external surfaces toward a second of the at least three external surfaces, and a conductive coating disposed on the second and third external surfaces and an interior surface of each of the holes, said bandwidth agile dielectrically loaded resonator filter having a predetermined response which is at least partially a bandpass type, which predetermined response bandwidth characteristics may be changed, said bandwidth agile dielectrically loaded resonator filter being coupled to said receiver and further comprising:

a first conductive layer disposed on the first external surface and coupled to the conductive coating disposed on the interior surface of a first of the holes;

a second conductive layer disposed on the first external surface and coupled to the conductive coating disposed on the interior surface of a second of the holes;

a first conductive strip disposed on the first external surface essentially between said first and second holes;

means for switching, coupled between said first conductive strip and the conductive coating disposed on the third external surface; and means, coupled to said transmitter and said means for switching, for selecting at least one desired response bandwidth of said bandwidth agile dielectrically loaded resonator filter.

* * * * *